United States Patent [19]

Rella

[11] 4,163,492

[45] Aug. 7, 1979

[54] SAFETY PACKAGE OF TOOTHPICK HOLDER

[75] Inventor: Hermogenes Rella, Itatiba, Brazil

[73] Assignee: A. Rela s/a Industria e Comercio, Sao Paulo, Brazil

[21] Appl. No.: 884,283

[22] Filed: Mar. 7, 1978

[30] Foreign Application Priority Data

Oct. 21, 1977 [BR] Brazil ..... 7707080

[51] Int. Cl.[2] ..... B65D 83/02; B65D 85/24

[52] U.S. Cl. ..... 206/380; 229/17 R; 229/38; 312/73

[58] Field of Search ..... 206/380; 221/312 R; 229/38, 17 R, 7 R; 312/73

[56] References Cited

U.S. PATENT DOCUMENTS

| | | | |
|---|---|---|---|
| 1,141,489 | 6/1915 | Richardson | 229/38 |
| 1,832,735 | 11/1931 | Puyuelo | 229/7 R |
| 2,379,038 | 6/1945 | Rous | 229/17 R |
| 2,467,702 | 4/1949 | Smart | 229/38 |

*Primary Examiner*—William T. Dixson, Jr

*Attorney, Agent, or Firm*—Benasutti Associates, Ltd.

[57] ABSTRACT

Patent of invention "Safety Package of Toothpick Holder", comprising only one cardboard, laterally equipped with four faces (1-2-3-4) and an edge (5) for glueing at the inner part of the opposite face i.e. (4), and having, at the uppermost side, two edges (19–22) overlaying one another and another (26) with three cuttings (29) where pass a trapezoid projection (31) of another edge (30), in such a way that the foldable ears (32) of such projection (31) block the cover. Furthermore, there are, at the said edge (22), a cutting (25) in alignment with a hole (F) for the output of the toothpicks. Similar edges form the bottom.

9 Claims, 5 Drawing Figures

SAFETY PACKAGE OF TOOTHPICK HOLDER

BACKGROUND OF THE INVENTION

The present invention relates to a safety package for keeping toothpicks in good hygienic condition and yielding these toothpicks only through contact of the human hand of the user. It is known by the experts of this art, that several ways of packing have appeared in the market, turning them touched only by the user's hands, and some of it including new characteristics for this purpose, and still other primitives requiring a sheet around them, leaving exposed the remaining toothpicks. Even the more perfect packages could not stand the user's curiosity, who pressed the packages, spoiling the remaining toothpicks.

SUMMARY OF THE INVENTION

Having in mind to compete in creativity with the best toothpick packages and to offer to the consumer market a way of preserving the toothpicks during transportation, and when exposed in the supermarket stands, making possible its use by the outlet of toothpicks one by one, the inventor has created the package, the object of this application, which comprises a box cut in light carboard or any other means of packing or box material, such as plastic, and having creases made by the folding machine and special profile cuttings, which fit into grooves previously placed, in such a way as to allow its perfect and safe closing, and the individual outlet of toothpicks, that is achieved by means of combined perforations.

In order that one may have a perfect picture and knowledge of this patent, it is represented in the appended drawings, and depicted in the descriptive report, showing the best way of presenting the invention.

DESCRIPTION OF THE PREFERRED EMBODIMENT

Figure 1:
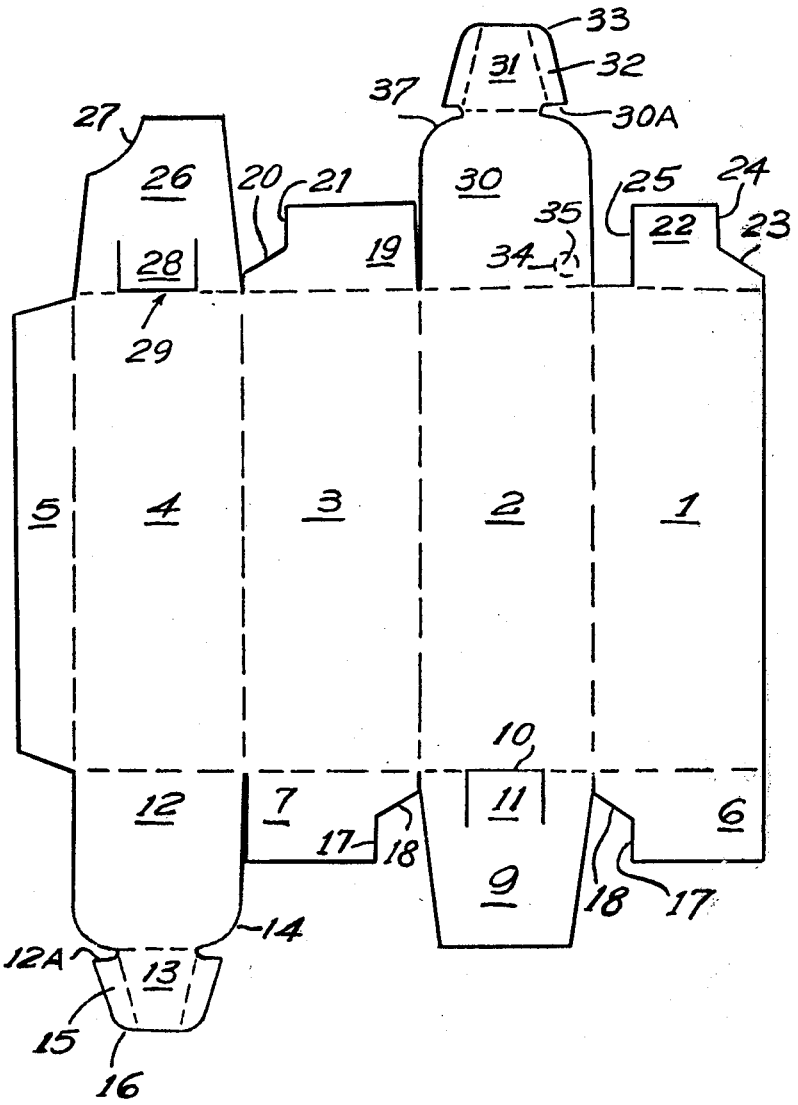
FIG. 1 is a view of the cut cardboard, molded and creased.

With reference to the mentioned drawings, now in more detail, the FIG. 1 comprises a creased and cut package, being formed by a sufficient number of sides in order to create an internal useful space, to contain the toothpicks, which may assume several shapes, as in the present case, in the shape of a parallelepiped. This toothpick holder is formed by only one creased cardboard divided in four fundamental faces (1-2-3-4) and one foldable edge (5), to be glued to side (4), defining an homogeneous piece with opened bases.

The edges (6-7), having the cuttings (17-18), and the edge (9), having the cuttings (10) defining an internal edge (11), and one more edge (12), with curved portions (14), in connection with a trapezoidal projection (13), provided with foldable ears (15) in creases with steps (12A), define the lower base and to define a box, the edges (6-7) and after the edges (9) and (12) overlay one another, forming the bottom of the package. The trapezoidal projection (13), with its folded ears (15), is introduced in three grooves (10) of the edge (9).

Figure 4:
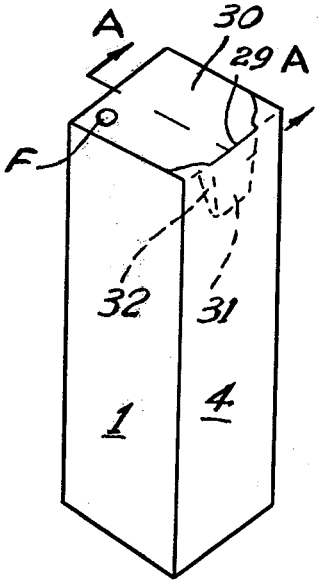

The cover of the package is formed by the edges (19-22), having grooves (20-21-23-24), in which the edge (22), for instance, possesses one another groove (25) defining an open space for the output of the toothpick one by one. Furthermore, the cover has an edge (26) possessing a concave cutting (27), in such a way to permit the exit of one toothpick out of the package, besides of another groove (29), defining an inner edge (28); at the opposite side of the upper edge another edge (30) is provided, in which this edge possesses curved portions (37) and a trapezoidal projection (31), with curved portion (33) and foldable ears (32) provided with steps (30A); in this edge (30), there is a circular crease defining an area (35), which is detachable of the cover. In this manner, it is possible to get a hole (F), for the output of the toothpicks one by one, as can be seen at FIG. 4 of the drawings.

Figure 2:
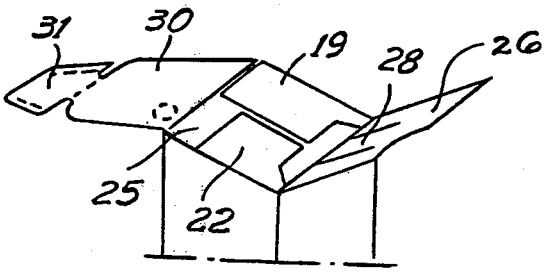
FIGS. 2, 3, and 4 are views showing the several steps of the mounting.
Figure 3:
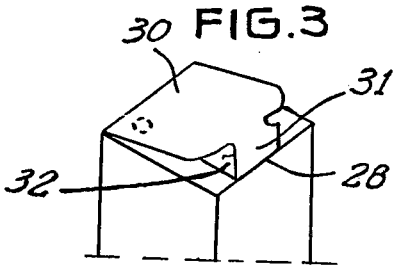
Figure 5:
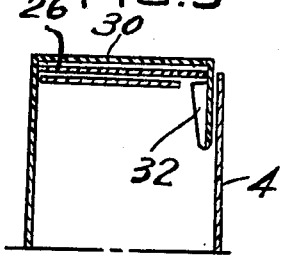
FIG. 5 shows the uppermost face of the toothpick holder, according the lines and arrows A—A in FIG. 4.

With the toothpicks placed inside the box, it is possible to close the upper side, or cover of the holder folding the edges (19-22-26-30) in such a way that the trapezoidal projection (31) passes, with its folded ears (32), inside the three grooves (28). See FIGS. 2 and 3. These ears (32), inside the three grooves, are opened, as shown in more detail at FIGS. 4 and 5. Then, it would be practically impossible to move the projection (31) outwardly.

As it is easily understood, the description of the components of this invention and its utility in packages for toothpick holder, of easy mounting and safety locking of perfect industrialization, deserves the claimed privilege.

It will be understood that various changes in the details, materials and arrangement of parts will have been herein described and illustrated in order to explain the nature of this invention, may be made by those skilled in the art within the principle and scope of the invention as expressed in the following claims.

What is claimed is:

1. A safety package for holding and dispensing toothpicks in a sanitary manner, said package comprising:
   (a) a plurality of sides and a gluing edge attached to one of said sides, said sides and said gluing edge being formed by a series of creases in a single piece of material;
   (b) a plurality of bottom edges attached to said sides which overlay one another to form a bottom of said package, said bottom edges being formed by a series of creases in said single piece of material; and
   (c) a plurality of cover edges attached to said sides which overlay one another to form a cover of said package, said cover edges being formed by a series of creases in said single piece of material and having a plurality of grooves and a hole for providing individual output of toothpicks, wherein said cover edges further comprise:
      (i) a first cover edge including a trapezoidal projection thereon having a plurality of ears which are foldable with respect to said projection, said projection and said ears being formed by a series of creases in said single piece of material; and
      (ii) a second cover edge having a slit therein for receiving said trapezoidal projection and folded ears when said edges are overlaid whereby said cover edges are locked in place.

2. The invention of claim 1 wherein said bottom edges further comprise:
   (a) a first bottom edge including a trapezoidal projection thereon having a plurality of ears which are foldable with respect to said projection, said projection and said ears being formed by a series of creases in said single piece of material; and (b) a second bottom edge having a slit therein for receiving said trapezoidal projection and folded ears when said edges are overlaid whereby said bottom edges are locked in place.

3. The invention of claim 2, wherein said slit is substantially "U"-shaped.

4. The invention of claim 1, wherein said means for providing individual output of toothpicks comprises a creased portion in a corner of said first cover edge for breaking and allowing individual access.

5. The invention of claim 4, wherein said safety package comprises cardboard.

6. A safety package for holding and dispensing toothpicks in a sanitary way, comprising:

(a) a plurality of sides and a gluing edge attached to one of said sides formed by a series of creases in a single piece of material;

(b) a plurality of bottom edges fastened to said sides which overlay one another to form a bottom;

(c) a plurality of cover edges fastened to said sides which overlay one another to form a cover, said cover edges further comprising:

(i) a first edge having an inner slit;

(ii) a pair of edges having at least one edge side groove for overlaying said inner slit when said edges are overlaid to form said covers;

(iii) a second edge having a projection which includes a pair of ears formed by creases along the side of said second edge, said ears being foldable toward said second edge along said creases and being biased to return to a substantially co-planar position with respect to said second edge, said inner slit being adapted to receive said projection and folded ears through said side grooves when the cover edges are overlaid and to prevent the withdrawal of said projection when said ears return to said substantially co-planar position;

(iv) a creased portion in a corner of said second edge for breaking and allowing individual access; and (v) at least one edge of said pair of edges having a second side groove and said first edge having a concave cutting, said second side groove and said concave cutting being in substantial alignment and overlaid by said creased portion when said edges are overlaid to form said cover.

7. The safety package in accordance with claim 6 wherein said inner slit is substantially "U"-shaped and said projection is substantially trapezoidal in shape, with said ears being disposed along the non-parallel edges thereof, for insertion into said slit when said edges are overlaid whereby said cover is locked in place.

8. The safety package in accordance with claim 6 wherein said bottom edges include:

(a) a first edge having an opening therein; and (b) a second edge having a projection which includes a pair of creased ears for insertion into said opening when said edges are overlaid whereby said bottom is locked in place.

9. The safety package in accordance with claim 8 wherein said opening comprises a substantially "U"-shaped slit and said projection is substantially trapezoidal in shape, with said ears being disposed along the non-parallel edges thereof.

* * * * *